US006029446A

United States Patent [19]

Duppong et al.

[11] Patent Number: 6,029,446

[45] Date of Patent: Feb. 29, 2000

[54] MULTIFUNCTION VALVE STACK

[75] Inventors: Gerald J. Duppong; Knute K. Brock; Thomas M. Sagaser, all of Bismarck, N. Dak.

[73] Assignee: Melroe Company, Fargo, N. Dak.

[21] Appl. No.: 08/937,919

[22] Filed: Sep. 25, 1997

Related U.S. Application Data

[63] Continuation of application No. 08/623,168, Mar. 28, 1996, abandoned.

[51] Int. Cl.[7] ..... F16D 31/02

[52] U.S. Cl. ..... 60/424; 60/426; 60/421; 91/520; 91/531; 91/536

[58] Field of Search ..... 60/420, 421, 424, 60/426; 91/520, 536, 531

[56] References Cited

U.S. PATENT DOCUMENTS

| | | | |
|---|---|---|---|
| 2,322,740 | 6/1943 | Vanderzee et al. | 60/52 |
| 3,146,593 | 9/1964 | Stacey | 60/52 |
| 3,279,637 | 10/1966 | Olson et al. | 214/778 |
| 3,476,275 | 11/1969 | Witwer | 214/138 |
| 3,550,505 | 12/1970 | Byers, Jr. | 91/411 |
| 3,811,363 | 5/1974 | Cryder | 91/412 |
| 3,910,044 | 10/1975 | Symmank | 60/420 |
| 3,916,624 | 11/1975 | Machens et al. | 60/394 |
| 3,916,767 | 11/1975 | Barton | 91/412 |
| 3,922,855 | 12/1975 | Bridwell et al. | 60/421 |
| 3,960,284 | 6/1976 | Carpenter | 214/138 R |
| 4,023,364 | 5/1977 | Bianchetta | 60/421 |
| 4,024,710 | 5/1977 | Zelle | 60/420 |
| 4,030,623 | 6/1977 | Bridwell et al. | 214/138 R |
| 4,055,046 | 10/1977 | Schexnayder | 60/428 |
| 4,078,681 | 3/1978 | Field, Jr. | 214/138 R |
| 4,080,994 | 3/1978 | Flaschar et al. | 137/596.13 |
| 4,256,142 | 3/1981 | Hancock | 137/596.91 |
| 4,343,151 | 8/1982 | Lorimor | 60/422 |
| 4,526,085 | 7/1985 | Morizur et al. | 91/6 |
| 4,528,892 | 7/1985 | Okabe et al. | 91/520 X |
| 4,561,249 | 12/1985 | Watanabe et al. | 60/421 |
| 4,561,341 | 12/1985 | Aikawa | 91/6 |
| 4,570,441 | 2/1986 | Yoshida et al. | 60/421 |
| 4,622,886 | 11/1986 | Imada et al. | 91/520 |
| 4,768,339 | 9/1988 | Aoyagi et al. | 60/427 |
| 4,961,371 | 10/1990 | Takashima | 91/530 |
| 4,986,072 | 1/1991 | Kubomoto | 60/421 |
| 5,081,837 | 1/1992 | Ueno | 60/421 |
| 5,083,428 | 1/1992 | Kubomoto et al. | 60/421 |
| 5,335,494 | 8/1994 | Benko et al. | 60/428 |
| 5,471,908 | 12/1995 | Lech | 60/424 X |

FOREIGN PATENT DOCUMENTS

| | | |
|---|---|---|
| 0 059 471 | 9/1982 | European Pat. Off. . |
| 0 087 748 | 7/1983 | European Pat. Off. . |
| 0 393 195 | 10/1990 | European Pat. Off. . |

(List continued on next page.)

OTHER PUBLICATIONS

"Maximising Mini Excavator Performance", *Industrial Vehicle Technology '95*.

"Hydraulic Excavators From Melroe", *Worksaver* Magazine, Fall 1986, p. 23.

*Primary Examiner*—Hoang Nguyen

*Attorney, Agent, or Firm*—Westman Champlin & Kelly P.A.

[57] ABSTRACT

A power machine has a base, an operator support portion, and a hydraulic slew motor coupled to move the operator support portion relative to the base. A boom, an arm, and a tool are all coupled to one another and to the operator support portion and are powered by hydraulic actuators. A slew valve is coupled to receive hydraulic fluid under pressure from a hydraulic power circuit and is also coupled to the slew motor to provide hydraulic fluid to the slew motor and receive hydraulic fluid from the slew motor. A first power actuator valve is coupled to receive hydraulic fluid from the slew valve and is coupled to provide hydraulic fluid to one of the hydraulic boom actuator, the hydraulic arm actuator and the tool actuator. The slew valve is coupled in series with the power actuator valve.

24 Claims, 5 Drawing Sheets

FOREIGN PATENT DOCUMENTS

| | | |
|---|---|---|
| 2 193 156 | 2/1974 | France . |
| 2 407 300 | 5/1979 | France . |
| 2 486 121 | 1/1982 | France . |
| 24 40 251 | 3/1976 | Germany . |
| 32 16 249 A1 | 1/1983 | Germany . |
| 58-004035 | 1/1983 | Japan . |
| 58-146631 | 1/1983 | Japan . |
| 58-146631 | 9/1983 | Japan . |
| 62-107124 | 5/1987 | Japan . |

MULTIFUNCTION VALVE STACK

This is a continuation of application Ser. No. 08/623,168, filed Mar. 28, 1996 now abandoned.

BACKGROUND OF THE INVENTION

The present invention deals with power machines. More particularly, the present invention deals with the arrangement of valves in a power machine to provide multiple functions.

Mini-excavators are currently in wide use. Such excavators typically have a base portion which is supported by a pair of track assemblies. The track assemblies are powered by hydraulic motors.

The base portion typically supports a house, or operator support portion. The house is rotatable relative to the base portion. Rotation is powered by a hydraulic slew motor. Mini-excavators also typically have a number of other features. For example, a boom is typically coupled to the house. A power actuator, such as a hydraulic cylinder, is coupled to the boom to pivot the boom relative to the house about an arc substantially located in a vertical plane. The boom is also typically pivotable substantially in a horizontal plane. This type of pivoting movement is accomplished through the use of a hydraulic cylinder (referred to as an offset cylinder) coupled to the house and to the boom.

An arm is coupled to a distal end of the boom, and is also typically pivotable relative to the boom through use of a hydraulic cylinder. A tool is commonly coupled to the end of the arm and is manipulated, also through the use of a hydraulic cylinder. Such a tool may typically be a bucket pivotally coupled to the arm.

Also, a blade is commonly mounted to the base portion. The blade is raisable, and lowerable, by actuating a hydraulic cylinder. Other functions, such as auxiliary functions are also common.

While many hydraulic functions may be provided on the mini-excavator, there are typically four primary functions performed by the mini-excavator. The first is actuation of the bucket (or tool), the second is actuation of the arm, the third is actuation of the boom, and the fourth is operating the slew motor.

In prior excavators, the valves controlling these four hydraulic functions were placed in parallel with one another. Because of this parallel arrangement, if any of the functions were actuated simultaneously, the function requiring the least pressure obtained substantially all of the hydraulic fluid flow. Therefore, if two functions were actuated simultaneously, such as lifting the boom out of a hole, after the bucket is full of dirt, and rotating the cab (or house) the higher pressure of those functions would substantially stop while the other function was being performed.

Also, in prior excavators, it has been observed that two of the functions performed by the mini-excavator can tend to be more time consuming than the other functions. One of the time consuming functions is raising the boom, particularly when the bucket is filled with dirt or another heavy substance. The boom cylinder is generally quite a large cylinder and takes a great deal of hydraulic fluid for actuation. Providing enough hydraulic flow to the hydraulic actuator raising the boom can take significant time. The other function which can be time consuming is traveling in the excavator.

SUMMARY OF THE INVENTION

According to one feature of the present invention, a power machine has a base, an operator support portion, and a hydraulic slew motor coupled to move the operator support portion relative to the base. A boom, an arm, and a tool are all coupled to one another and to the operator support portion and are powered by hydraulic actuators. A slew valve is coupled to receive hydraulic fluid under pressure from a hydraulic power circuit and is also coupled to the slew motor to provide hydraulic fluid to the slew motor and receive hydraulic fluid from the slew motor. A first power actuator valve is coupled to receive hydraulic fluid from the slew valve and is coupled to provide hydraulic fluid to one of the hydraulic boom actuator, the hydraulic arm actuator and the tool actuator. The slew valve is coupled in series with the power actuator valve.

Another feature of the present invention is that a boost valve is provided which provides a hydraulic fluid boost to one of two hydraulic actuators in the hydraulic power circuit of the power machine. In one preferred embodiment, the boost valve is configured to boost either the boom cylinder or the travel motors.

DETAILED DESCRIPTION OF THE PREFERRED EMBODIMENTS

Figure 1:
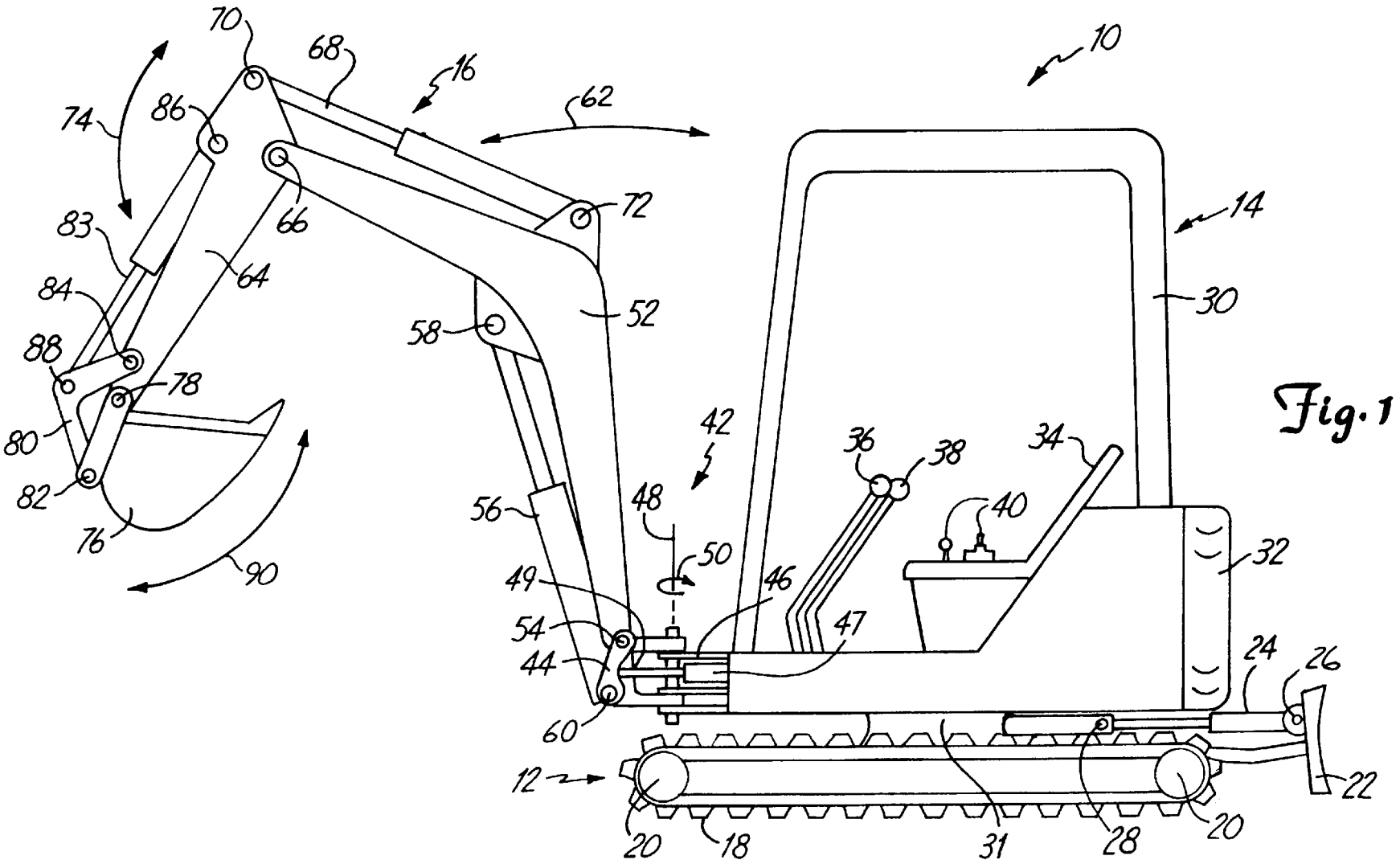
FIG. 1 is a side view of a mini-excavator according to the present invention.

FIG. 1 is a side view of a mini-excavator 10 according to the present invention. Mini-excavator 10 includes a base portion 12, an operator support portion (or house) 14, and a dipper assembly 16. Base portion 12 includes a frame (not shown) and a pair of tracks 18. Only one track 18 is shown in FIG. 1, and it will be appreciated that the second track 18 is identically, and oppositely, disposed on the other side of mini-excavator 10.

Tracks 18 are rotatable about a pair of hubs 20. At least one of hubs 20 is driven by a hydraulic motor (shown in FIG. 3). In the preferred embodiment, each track 18 is driven by a separate hydraulic travel motor to provide travel. The travel motors are controlled by the operator through manipulation of suitable controls in house 14.

Base portion 12 also includes a blade 22 which is pivotally coupled to the frame of base portion 12. Blade 22 is also pivotally coupled to a hydraulic cylinder 24 at pivot point 26. Hydraulic cylinder 24 is pivotally coupled to the frame of base portion 12 at pivot point 28. Hydraulic cylinder 24 is selectively provided with hydraulic fluid under pressure from a hydraulic power circuit which is described in greater detail later in the specification. The operator, upon the manipulation of appropriate controls, can raise and lower blade 22 by causing selective retraction and extension of hydraulic cylinder 24.

Operator support portion 14 includes a cab 30 which is rotatably coupled to the frame of the base portion 12 by a swivel joint 31. Cab 30 typically includes an engine compartment 32, a seat 34 for supporting the operator, and a plurality of hand controls for controlling mini-excavator 10. In the preferred embodiment, the hand controls include a pair of steering levers 36 and 38, and a number of joysticks 40.

Steering levers 36 and 38 are manipulated by the operator to steer mini-excavator 10. For example, pushing forward on lever 36 causes the hydraulic motor associated with lever 36 to drive the corresponding track 18 in the forward direction. Pulling back on lever 36 causes the hydraulic motor associated with lever 36 to drive the corresponding track 18 in the reverse direction. The same is true of lever 38 and its associated hydraulic motor. Joysticks 40 are preferably used by the operator to control other hydraulic actuators on mini-excavator 10.

Dipper assembly 16 is pivotally coupled to operator support portion 14 at joint 42. Dipper assembly 16 includes a bracket 44 which is pivotally mounted to a corresponding bracket 46 on operator support portion 14. Bracket 44 is pivotally mounted to pivot about an axis represented by numeral 48 and generally in a direction indicated by arc 50. It will be appreciated that arc 50 designates pivotal movement into and out of the page of FIG. 1 about axis 48. An offset cylinder 47 is mounted to operator support portion 14 and is pivotally mounted at pivot point 49 to bracket 44. As the operator controls the extension and retraction of offset cylinder 47, dipper assembly 16 is controlled to pivot through arc 50, about axis 48, into and out of the page of FIG. 1.

Dipper assembly 16 also includes a boom 52. Boom 52 is pivotally coupled to bracket 44 at pivot point 54. Boom 52 is also pivotally coupled to a hydraulic cylinder 56 at pivot point 58. Hydraulic cylinder 56 is, in turn, pivotally coupled to the bracket 44 at pivot point 60. Thus, as the operator controls the extension and retraction of hydraulic cylinder 56, boom 52 is raised and lowered through an arc 62 generally defined by a vertical plane.

Dipper assembly 16 also includes an arm 64 which is pivotally coupled to boom 52 at pivot point 66. Arm 64 is also pivotally coupled to a hydraulic cylinder 68 at pivot point 70. Hydraulic cylinder 68 is, in turn, pivotally coupled to boom 52 at pivot point 72. Thus, as the operator controls the extension and retraction of hydraulic cylinder 68, arm 64 pivots relative to boom 52 through an arc 74 and generally about pivot point 66.

Mini-excavator 10 also typically has a tool, such as bucket 76, coupled to the distal end of arm 64. Bucket 76 is pivotally coupled to arm 64 at pivot point 78. Bucket 76 is also pivotally coupled to a mounting bracket 80 at pivot point 82. Mounting bracket 80, in turn, is pivotally coupled to arm 64 at pivot point 84. A hydraulic cylinder 83 is also pivotally coupled to arm 64 at pivot point 86, and to mounting bracket 80 at pivot point 88. Thus, as the operator controls the extension and retraction of hydraulic cylinder 83, bucket 76 pivots generally through an arc 90 about pivot point 78.

It will be appreciated that the actuation of certain of the hydraulic motors or hydraulic actuators in mini-excavator 10 will require greater or lesser hydraulic pressure than others, depending upon the specific hydraulic motor or hydraulic actuator being actuated. For instance, the actuation of hydraulic cylinder 56, in order to extend hydraulic cylinder 56 and raise boom 52, may take a great deal of pressure, specifically if boom 52 is lifting bucket 76 out of a hole wherein bucket 76 is completely filled with dirt or another heavy substance. By contrast, the actuation of offset cylinder 47 to pivot dipper assembly 16 about axis 48 may take only a small amount of pressure, even if bucket 76 is full. Of course, offset cylinder 47 can take a great deal of pressure if the operator support portion is also being slewed, due to the requirement of overcoming certain inertial force components.

Figure 2A:
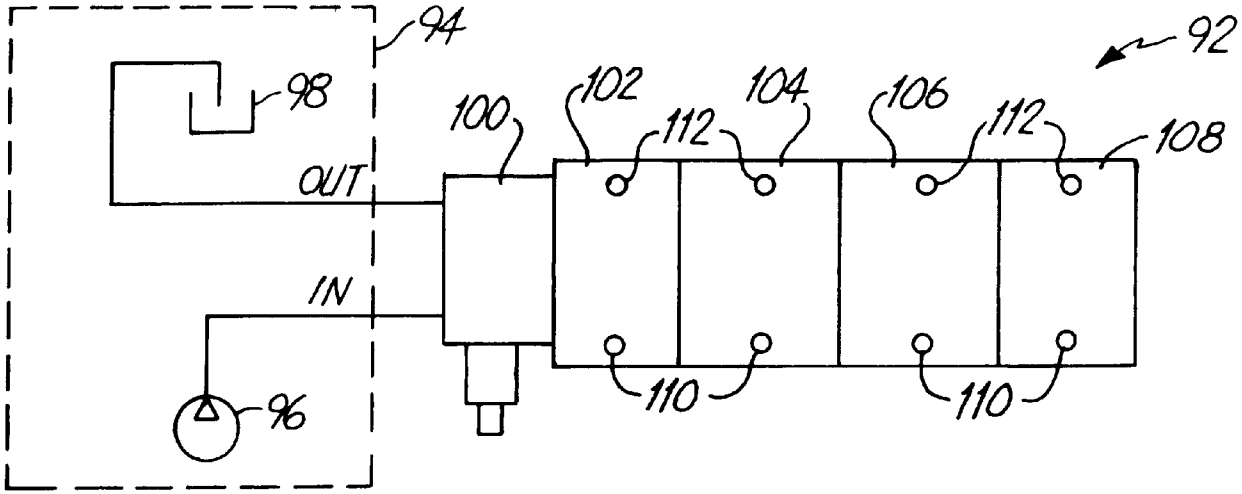
Fig. 2A (PRIOR ART)
FIG. 2A is a block diagram of a valve stack according to the prior art.

FIG. 2A shows a portion of a hydraulic circuit (in simplified block diagram form) of a prior mini-excavator. FIG. 2A shows a valve stack 92 coupled to a hydraulic fluid supply circuit 94. Hydraulic fluid supply circuit 94 is shown in greatly simplified form and includes pump 96 and tank or reservoir 98. Valve stack 92 includes relief valve 100, and a plurality of hydraulic actuator valves 102, 104, 106 and 108. Valve 102 is a slew valve which controls the flow of hydraulic fluid to the slew motor that causes rotation of operator support portion 14 about base portion 12. Valve 104 is a blade valve which controls the flow of hydraulic fluid to hydraulic cylinder 24 in order to manipulate blade 22. Valve 106 is a bucket valve that controls the flow of hydraulic fluid to hydraulic cylinder 83 in order to manipulate the position of bucket 76. Hydraulic valve 108 is an offset valve which controls the flow of hydraulic fluid to hydraulic cylinder 47 in order to control the position of dipper assembly 16 about axis 48. Relief valve 100 is typically configured to dump hydraulic fluid under pressure from pump 96 to tank 98 when the pressure at the inputs of valves 102–108 exceeds the threshold pressure (typically 2500 psi).

Each of valves 102–108 has an output port 110 which receives hydraulic fluid under pressure from pump 96 and an input port 112 which is coupled to provide the hydraulic fluid return to tank 98. In typical prior mini-excavators, valve stack 92 was configured so that valves 102–108 were connected in parallel with one another. In other words, the valves 102–108 were all connected to one another and to the input line from pump 96 by a common chamber. Similarly, the valves were all connected to one another and to the output line coupled to tank 98 by a common chamber.

Therefore, if two of the hydraulic functions which were controlled by any of valves 102–108 were simultaneously requested, and spools in those valves were moved from a neutral position to a work position (wherein hydraulic fluid is provided from pump 96 through an output 110), the function or hydraulic actuator which actually received the hydraulic fluid under pressure depended upon the pressure requirements of the two functions which were simultaneously requested. As indicated previously, in a parallel valve configuration, the lowest pressure function typically receives substantially all of the hydraulic fluid flow from pump 96, and the higher pressure function typically receives very little, if any, of the hydraulic fluid flow. Therefore, in an example in which slew valve 102 is actuated along with offset valve 108, the slew motor receives substantially all of the hydraulic fluid flow, and the offset actuator 47 receives substantially none of the hydraulic fluid flow. This is because under simultaneous movement of the slew motor and the offset cylinder, inertial force components can act to oppose movement of the offset cylinder such that the amount of pressure required to rotate operator support portion 14 relative to base 12 is significantly less than the amount of pressure required to pivot dipper assembly 16 about axis 48.

This has the effect of precluding the operator from being able to pivot dipper assembly 16 until the operator support portion 14 is rotated to a desired position so that the operator can again move slew valve 102 to the neutral position. Further, if the operator is pivoting dipper assembly 16 and then simultaneously actuates slew valve 102, rotation of dipper assembly 16 stops and operator support portion 14 is rotated to its desired position. Only after this occurs and the slew valve 102 is again returned to the neutral position does the offset cylinder again receive hydraulic fluid under pressure and continue to rotate dipper assembly 16.

Figure 2B:
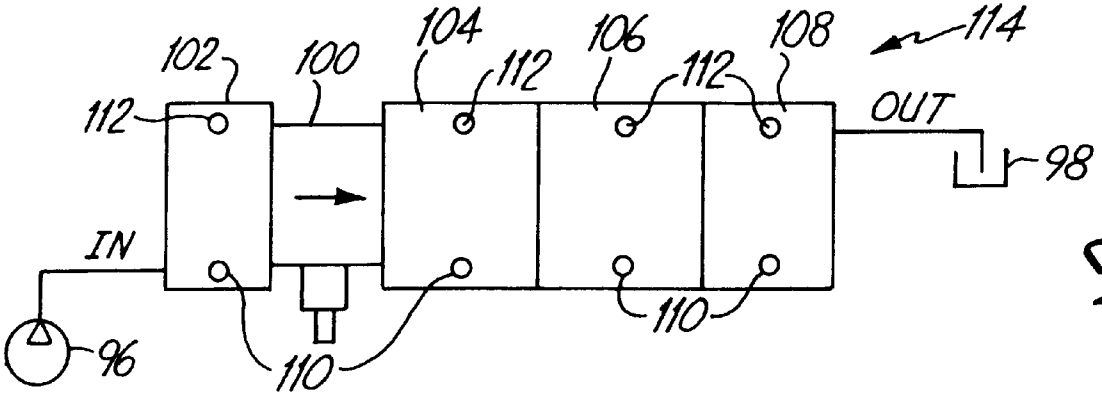
FIG. 2B is a block diagram of a valve stack according to the present invention.

FIG. 2B shows a valve stack 114 according to the present invention in simplified block diagram form. Valve stack 114 contains substantially all of the same components as valve stack 92, and those components are similarly numbered. However, the components are configured differently in valve stack 114 than in valve stack 92. Specifically, valve stack 114 has valves 104, 106 and 108 coupled in parallel with one another, while slew valve 102 is coupled in series with the parallel combination of valves 104, 106 and 108. Also, relief valve 100 is moved downstream of valve 102.

Figure 3A:
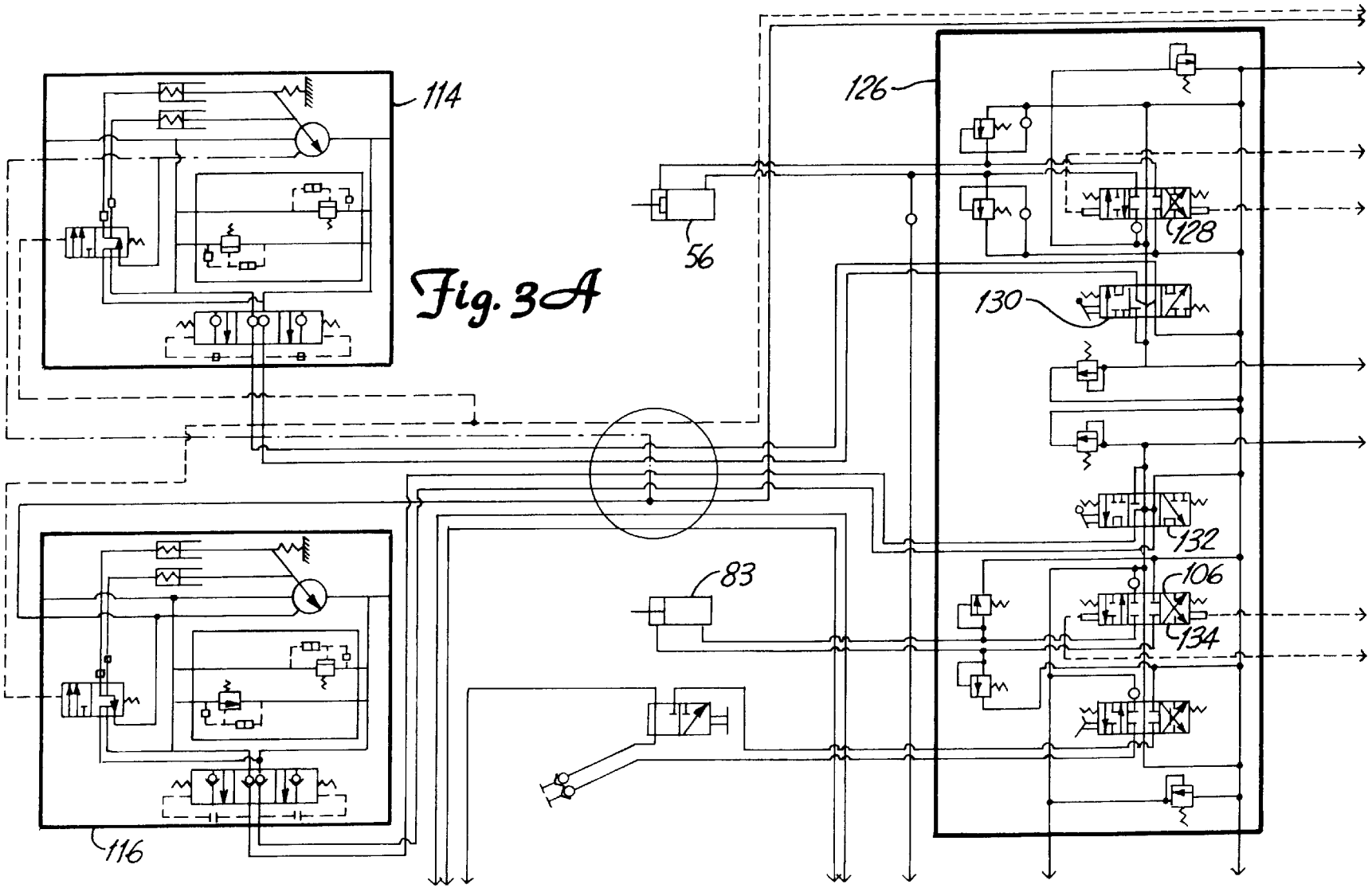
FIG. 3 is a more detailed schematic diagram of a hydraulic system according to the present invention.
Figures 3, 3B:
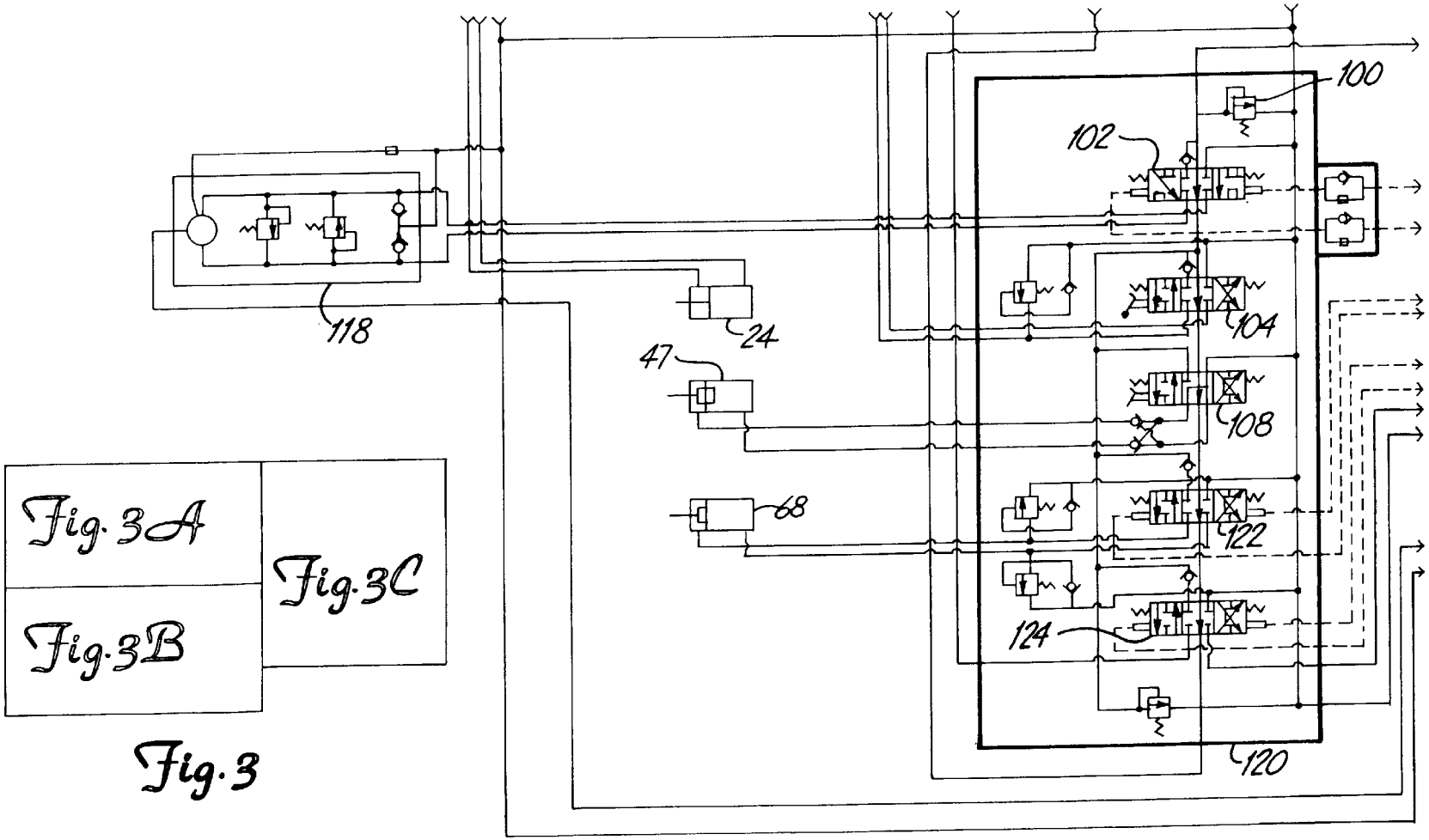
Figure 3C:
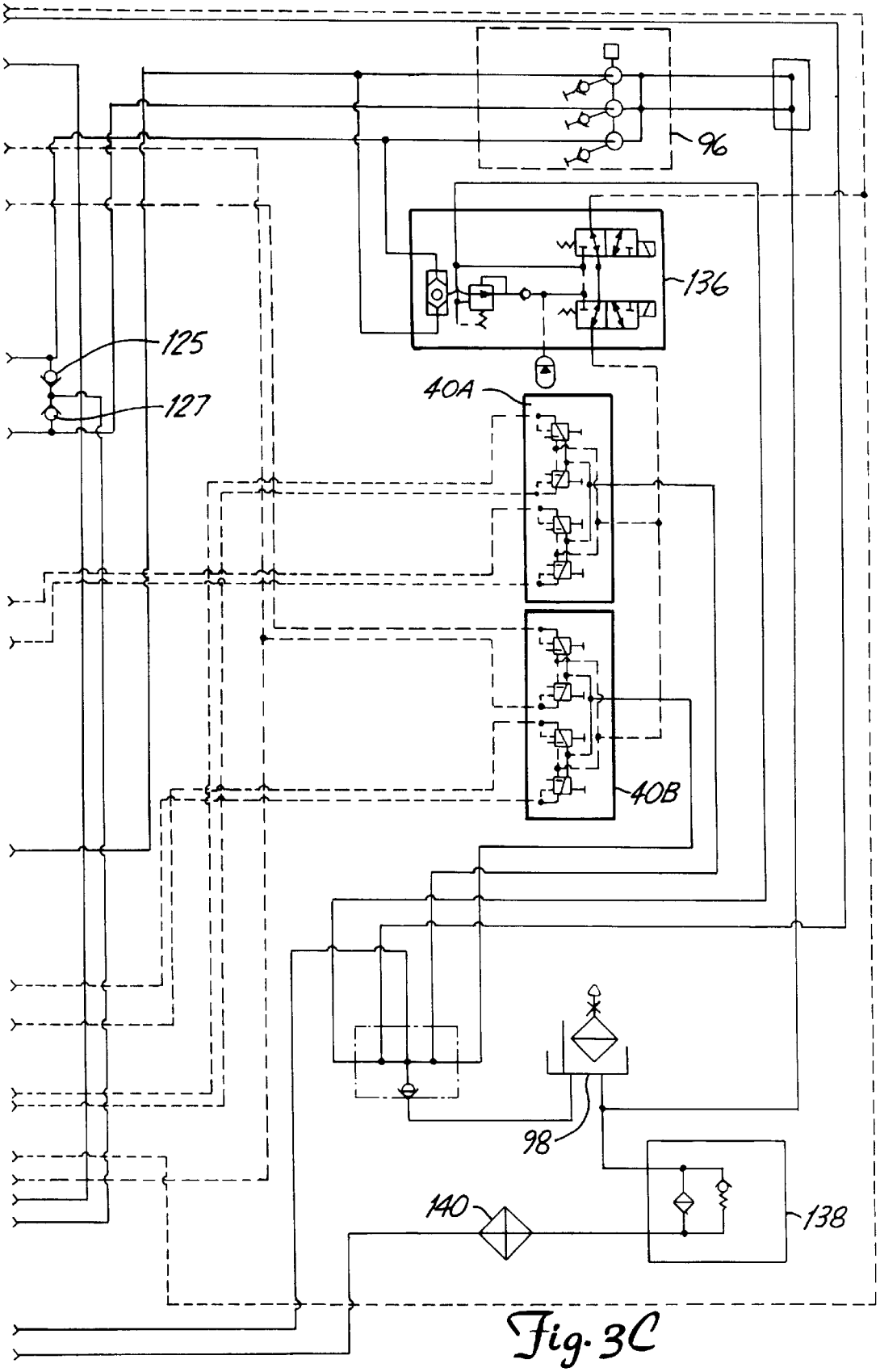

Since the slew motor, which is described in greater detail with respect to FIG. 3, is a hydraulic motor, instead of a hydraulic cylinder, hydraulic fluid which is provided to the slew motor through valve 102 is circulated through the slew motor and is returned to valve 102. Therefore, any hydraulic fluid under pressure which is diverted to the slew motor through valve 102 is returned to valve 102 and is provided downstream to the remainder of valves 104–108. Rather than having inlet port 112 of valve 102 plumbed directly to tank 98, the inlet port 112 is provided to the outlet ports 110 of valves 104, 106 and 108, since valves 104, 106 and 108 are connected in parallel with one another.

The effect of this is that the operator can now perform the slew function controlled by valve 102 along with any one of the other hydraulic functions controlled by valves 104, 106 or 108. For example, if the operator is slewing the operator support portion 14, all of the hydraulic fluid provided to the slew motor is returned to valve stack 114 and also provided to the parallel combination of valves 104, 106 and 108. Therefore, that hydraulic fluid under pressure is still available to perform any of the hydraulic functions performed by those downstream valves. Similarly, if the operator is actuating any of the cylinders controlled by valves 104, 106 and 108, and then wants to slew operator support portion 14, the operator can do so substantially without interruption to either the slew operation or the other hydraulic operation previously performed.

In the preferred embodiment, slew motor 102 is provided with its own cross-port relief valves. Therefore, relief valve 100 can be moved downstream of slew valve 102 without jeopardizing the integrity of the relief system in the hydraulic power circuit. Even in the instance in which the cross-port relief valves in the hydraulic slew motor are actuated, the hydraulic fluid under pressure is simply diverted to the low pressure side of the hydraulic slew motor, and the hydraulic fluid is returned to valve 102 and provided downstream to the remainder of valves 104–108.

It should also be noted that while valves 102, 104, 106 and 108 are depicted in FIG. 2B as control valves for controlling the slew motor, the blade cylinder, the bucket cylinder and the offset cylinder, the valves can be assigned to control any appropriate or desired hydraulic functions on mini-excavator 10.

FIG. 3 is a more detailed schematic diagram of a hydraulic power circuit according to the present invention. The power circuit shown in FIG. 3 includes right hand hydraulic travel motor 114, left hand hydraulic travel motor 116, and slew motor 118. FIG. 3 shows blade cylinder 24, boom offset cylinder 47, boom cylinder 56, arm cylinder 68 and bucket cylinder 83 and those items are similarly numbered to those shown in FIG. 1. The relief valve 100, slew valve 102, blade valve 104, bucket valve 106 and boom offset valve 108 are also shown and are similarly numbered to those elements shown in FIG. 2B. However, in FIG. 3, valves 100, 102, 104, 106 and 108 are slightly reconfigured. In the embodiment shown in FIG. 3, valves 100, 102, 104 and 108 are in a valve stack 120, along with arm valve 122 which is utilized to control arm cylinder 68, and boost valve 124 which will be described in greater detail later in the specification.

A second valve stack 126 includes bucket valve 106, boom valve 128 which is used to control boom cylinder 56, right hand travel valve 130 which is used to control right hand travel motor 114, left hand travel valve 132 which is used to control left hand travel motor 116, and an auxiliary valve 134 which is used to control one of any number of auxiliary components which can be coupled to valve 134. All of the valves shown in FIG. 3 are depicted in the neutral position but are movable to one of two work positions designated as the A or B positions.

In FIG. 3, pump 96 is actually formed of three hydraulic fluid pumps connected along three fluid source lines to the valve stacks 120 and 126. FIG. 3 also shows operator input devices, which are depicted as joysticks 40A and 40B. Joystick 40A is preferably a right hand joystick located on the right hand side of seat 34, while joystick 40B is a left hand joystick located on the left hand side of seat 34. Joystick 40A is operable, based upon its position, to provide a pilot pressure to bucket valve 106 and arm valve 122. Joystick 40B is operable, depending on its position, to provide pilot pressure to boom valve 128 and slew valve 102. A pressure reducing valve arrangement 136 is also coupled to pumps 96. Pressure reducing valve arrangement 136 reduces the pressure of the hydraulic fluid provided by pumps 96 and provides it to joysticks 40A and 40B. This pressure reduction is necessary to reduce the pressure to an appropriate pilot pressure used to actuate the various valves actuated by joysticks 40A and 40B. Tank 98 also has an associated filter and bypass arrangement 138 which includes a fluid filter and a high pressure bypass line. Tank 98 also has an associated hydraulic fluid cooler 140.

In the preferred embodiment, slew valve 102, which controls slew motor 118, is coupled in series with the parallel combination of blade valve 104, boom offset valve 108, arm valve 122 and boost valve 124. Therefore, when slew valve 102 is in the neutral position shown in FIG. 3, the hydraulic fluid under pressure provided by pump 96 simply passes through valve 102 to the parallel combination of valves 104, 108, 122 and 124. However, when the operator manipulates joystick 40B to actuate the slew motor such that valve 102 moves to either position A or position B, hydraulic fluid under pressure is provided through valve 102 to slew motor 118 causing rotation of operator support portion 14 relative to base 12. The direction of rotation depends upon whether valve 102 is in position A or position B.

In either case, the hydraulic fluid under pressure provided to slew motor 118 is returned to valve 102 after it circulates through motor 118. This hydraulic fluid under pressure is then passed through valve 102 to the parallel combination of valves 104, 108, 122 and 124. Therefore, all of the hydraulic fluid under pressure provided to valve 102, regardless of whether it is diverted to slew motor 118, is available to the parallel combination of valves 104, 108, 122 and 124 for actuation of any of the cylinders associated with those valves.

This means that the operator can slew operator compartment 14 while still actuating blade cylinder 24, boom offset cylinder 47, or arm cylinder 68. When any of those cylinders are actuated, the hydraulic fluid under pressure is provided to the appropriate cylinder and hydraulic fluid is removed from the opposite side of that cylinder and diverted to tank 98.

FIG. 3 also shows that a similar technique to that used to for valve stack 120 is also used in valve stack 126. In other words, the hydraulic fluid under pressure provided by pumps 96 is first provided to the valves which control the hydraulic travel motors 114 and 116. Therefore, after the hydraulic fluid travels through motors 114 or 116, it is returned to the appropriate valve 130 and 132 and made available to hydraulic control valves downstream of that valve. In other words, the hydraulic fluid which is provided from valve 130 to right hand travel motor 114 is returned to valve 130, after it circulates through motor 114, and is made available to boom valve 128 so that the boom cylinder 56 can be actuated while the right hand travel motor 114 is also moving. Similarly, the hydraulic fluid under pressure which is provided through left hand travel valve 132 to left hand travel motor 116 is returned to valve 132, after it circulates through motor 116, and is thus made available to valves 106 and 134 which are located downstream of left hand travel valve 132. Therefore, the bucket cylinder 83, or an auxiliary implement coupled to auxiliary valve 134, can also be actuated even while left hand travel motor 116 is running.

By arranging either or both of valve stacks 120 and 126 according to the present invention, at least four functions can be simultaneously obtained even though only three pumps are used. This allows more efficient operation of mini-excavator 10 without the significant hardware cost involved in adding and plumping another pump 96. Further, by using the cross-port relief valves already found in slew motor 118 and travel motors 114 and 116, the present invention can be implemented substantially without the use of any additional hardware. In addition, it does not matter whether the cross-port relief valves are actuated. The over pressure hydraulic fluid is still channeled to the remainder of the valves located downstream of the hydraulic motors.

Valve stack 120 also includes a power beyond feature and a boost feature. In the event that none of the hydraulic cylinders 104, 108 or 122 are actuated, or in the event that any of those valves are actuated but there is excess hydraulic fluid flow available, that hydraulic fluid flow passes to boost valve 124. If boost valve 124 is controlled to remain in its neutral position, any hydraulic fluid reaching boost valve 124 is diverted to auxiliary valve 134 and bucket valve 106. This places the outputs from two pumps in a configuration to service the auxiliary valve 134 and the bucket valve 106. This, in contrast to prior mini-excavators, allows the auxiliaries to substantially always be active.

Further, if the operator manipulates joystick 40A to place boost valve 124 in position A, any excess hydraulic fluid that reaches boost valve 124 is provided to the base end of boom cylinder 56. Thus, this hydraulic fluid flow is provided to aid the extension of boom cylinder 56 to raise boom 52. Since the boom cylinder 56 is a relatively large cylinder, a great deal of oil must be provided to cylinder 56 in order to raise boom 52. This can be a fairly time consuming process. Therefore, the boost valve 124 according to the present invention provides additional hydraulic fluid to the base of boom cylinder 56 in order to increase the speed of the lifting operation.

Also, if the operator moves boost valve 124 to position B, then any excess hydraulic fluid which reaches valve 124 is diverted to the left and right hand travel motors through valves 132 and 130, respectively. The hydraulic fluid from boost valve 124 to the left and right hand travel motors is simply provided through a pair of check valves 125 and 127. Therefore, the excess hydraulic fluid reaching boost valve 124 is made available to the travel motors 114 and 116 to increase the travel speed of mini-excavator 10.

Boost valve 124 is thus actuable between two positions to provide excess hydraulic fluid to boost the operation of one of two hydraulic functions. Since only a single valve is used to boost one of two hydraulic functions, boost valve 124 provides an effective method of increasing the efficiency of mini-excavator 10 without a great deal of excess hardware.

Another feature of implementing boost valve 124 increases the fluid metering resolution. There are typically two ways in which valve spools are stroked. The first is to mechanically push or pull on a tang which protrudes from the valve with a cable or other mechanical linkage. This type of spool is referred to as a manually operated valve spool. The second is to connect a low pressure hydraulic line (the pilot pressure) to stroke the spool hydraulically. This is referred to as a hydraulically actuated spool. In the embodiment shown in FIG. 3, the valve spools are hydraulically actuated using low pilot pressure from pressure reducing valve 136 through joysticks 40A and 40B. In the preferred embodiment, boost valve 124 is regulated to actuate at a predetermined pilot pressure, different from the pilot pressure which actuates the boosted valve spools, to achieve desired operation.

For instance, it would not be desirable to immediately dump all of the boost fluid from boost valve 124 into the boosted actuator at the beginning of actuation of the boosted actuator. This would result in an inability to obtain fine metering of the oil, and could result in rough operation of the boosted cylinder. Therefore, boost valve 124 is typically configured so that it will not be actuated until the pilot pressure actuating the spool in the valve controlling the boosted actuator reaches a predetermined level.

By way of example, the pilot pressure provided to boom valve 128 in order to initially actuate boom valve 128 may typically be 80 psi. Therefore, when the pilot pressure reaches 80 psi, hydraulic fluid begins to flow out of one of the work ports of valve 128 into either the rod or base of boom cylinder 56. In that instance, boost valve 124 is configured so the pilot pressure to boost valve 124 must be greater than 80 psi before boost valve 124 will begin diverting hydraulic fluid to boom cylinder 56. In the preferred embodiment, where boom valve 128 is actuated starting at 80 psi, boost cylinder 124 is configured so that it will not begin diverting hydraulic fluid to boom cylinder 56 until the pilot pressure reaches 125 psi. Also, boom cylinder 128 may typically require 300 psi of pilot pressure before the valve is fully stroked. In that instance, boost valve 124 is configured so that 300 psi also corresponds to valve 124 being fully stroked. Therefore, in operation, the operator will move joystick 40B so that it provides 80 psi to boom valve 128 and boost valve 124. This causes boom valve 128 to begin to provide hydraulic fluid under pressure to boom cylinder 56, while boost valve 124 remains closed. As the operator continues to move joystick 40B such that the pilot pressure to boom valve 128 increases to 125 psi, boom valve 128 will provide more hydraulic fluid to boom cylinder 56 and boost valve 124 will just then begin to provide hydraulic fluid under pressure to boom cylinder 56. As the operator continues to move joystick 40B to increase the pilot pressure to boom valve 128 and boost valve 124, both valves open further and provide additional hydraulic fluid to boom cylinder 56. This continues until 300 psi of pilot pressure is provided to boom valve 128 and boost valve 124 at which point both valves are fully stroked and provide full hydraulic fluid under pressure to boom cylinder 56.

In the preferred embodiment, the boost valve 124 is used to boost either the boom lift function, or the travel speed function. While this is only the preferred embodiment, it has been found to be quite practical since a boom boost operation is typically not desired when mini-excavator 10 is travelling, and when mini-excavator 10 is digging, it is typically not traveling. However, it should be noted that additional boost valves can be used to boost other operations, or boost valve 124 can be reconfigured to boost any other desired operation, other than travel or the boom raising function.

While the present invention is illustrated in an open center system using three individual fixed displacement pumps, it could also be implemented in a closed center system as well.

Although the present invention has been described with reference to preferred embodiments, workers skilled in the art will recognize that changes may be made in form and detail without departing from the spirit and scope of the invention.

What is claimed is:

1. A power machine, comprising a base;

an operator support portion coupled to the base;

a hydraulic power circuit providing hydraulic fluid under pressure;

a hydraulic slew motor coupled to move the operator support portion relative to the base;

a boom coupled to the operator support portion;

a hydraulic boom actuator coupled to the boom to move the boom relative to the operator support portion;

an arm coupled to the boom;

a hydraulic arm actuator coupled to the boom and the arm to move the arm relative to the boom;

a tool coupled to the arm;

a tool actuator coupled to the tool to move the tool relative to the arm;

a slew valve coupled to receive the hydraulic fluid under pressure from the hydraulic power circuit and coupled to the slew motor to provide hydraulic fluid to the slew motor and receive hydraulic fluid from the slew motor; and a first power actuator valve coupled to receive hydraulic fluid from the slew valve if the hydraulic fluid is first provided by the slew valve to the slew motor and then returned to the slew valve from the slew motor and if the hydraulic fluid is not provided to the slew motor by the slew valve, the first power actuator valve being coupled to provide hydraulic fluid to one of the hydraulic boom actuator, the hydraulic arm actuator and the tool actuator.

2. The power machine of claim 1 and further comprising:

a relief valve coupled to receive hydraulic fluid from the slew valve and provide it to the first power actuator valve when the hydraulic fluid is below a pressure threshold and to divert the hydraulic fluid to a low pressure portion of the hydraulic power circuit when the hydraulic fluid reaches the pressure threshold.

3. The power machine of claim 1 and further comprising:

a second power actuator valve coupled in parallel with the first power actuator valve and coupled to another of the hydraulic boom actuator, the hydraulic arm actuator and the tool actuator.

4. The power machine of claim 3 and further comprising:

a third power actuator valve coupled in parallel with the first power actuator valve and coupled to yet another of the hydraulic boom actuator, the hydraulic arm actuator, and the tool actuator.

5. The power machine of claim 1 and further comprising:

a traction assembly operably coupled to the base;

a travel motor coupled to the traction assembly; and a boost valve actuable between a first position and a second position to selectively provide hydraulic fluid from the hydraulic circuit to the travel motor when in the first position and to one of the hydraulic boom actuator, the hydraulic arm actuator and the tool actuator when in the second position.

6. The power machine of claim 5 wherein the boost valve is coupled down stream of valves associated with the hydraulic boom actuator, the hydraulic arm actuator and the tool actuator.

7. The power machine of claim 1 wherein the slew motor includes a pressure relief system diverting the hydraulic fluid to a low pressure portion of the slew motor upon the hydraulic fluid reaching a pressure threshold.

8. The power machine of claim 7 wherein the hydraulic fluid diverted to the low pressure side of the slew motor is returned to the slew valve and provided to the first power actuator valves.

9. The power machine of claim 6 wherein the boost valve from the hydraulic circuit is movable to a neutral position to provide hydraulic fluid to a valve associated with a hydraulic actuator.

10. A power machine comprising:

a base;

first and second track assemblies mounted to the base to provide travel of the power machine;

first and second hydraulic traction motors receiving hydraulic fluid under pressure through an associated traction valve, the traction motors being coupled to the first and second track assemblies, respectively, to drive the first and second track assemblies;

an operator support portion movably coupled to the base;

a hydraulic slew motor operably coupled to the base and the operator support portion to move the operator support portion relative to the base;

a plurality of hydraulic actuators; and hydraulic power circuit providing hydraulic fluid under pressure to the slew motor and the plurality of hydraulic actuators, the hydraulic power circuit comprising:

a pump;

a plurality of valves coupled to the pump, one of the valves comprising a slew valve and being coupled to the slew motor, and each of a remainder of the plurality of valves also being coupled to one of the hydraulic actuators; and a boost valve actuable between a first position and a second position and coupled to receive hydraulic fluid under pressure, the boost valve directing the received hydraulic fluid under pressure to a boosted actuator comprising at least one of the traction motors when the boost valve is in the first position and at least one of the plurality of hydraulic actuators when the boost valve is in the second position.

11. The power machine of claim 10 wherein the boost valve is coupled down stream of the plurality of valves such that the boost valve receives hydraulic fluid under pressure that has not been previously diverted from the boost valve by one of the plurality of valves.

12. The power machine of claim 11 wherein the power machine includes a boom, wherein the plurality of power actuators includes a hydraulic boom actuator and wherein the boosted actuator comprises the hydraulic boom actuator when the boost valve is in the second position.

13. The power machine of claim 10 wherein the slew valve is coupled upstream of, and in series with, the remainder of the plurality of valves such that hydraulic fluid under pressure diverted to the slew motor by the slew valve returns from the slew motor to the slew valve and is subsequently made available to the remainder of the plurality of valves.

14. The power machine of claim 10 wherein the valve associated with the boosted actuator is movable between a full off position and a full on position, and wherein the boost valve begins directing hydraulic fluid under pressure to the boosted actuator when the valve associated with the boosted actuator is located at a predetermined position from the full off position to the full on position.

15. An excavator, comprising:

first and second track assemblies;

first and second hydraulic traction motors coupled to the first and second track assemblies, respectively;

a house rotatably mounted to the track assemblies;

a hydraulic slew motor coupled to the house to rotate the house;

a plurality of movable elements, movable relative to the house;

a plurality of hydraulic actuators coupled to the plurality of movable elements to controllably move the movable elements;

a hydraulic power circuit providing hydraulic fluid under pressure to the hydraulic traction motors, the hydraulic slew motor and the plurality of hydraulic actuators, the hydraulic power circuit comprising:

a pump system providing the hydraulic fluid; and a valve stack including a motor valve coupled to the pump system and a motor comprising one of the slew motor, the first hydraulic traction motor, and the second hydraulic traction motor, the valve stack including an actuator valve coupled to one of the plurality of hydraulic actuators and to the pump system down stream of the motor valve, the motor valve being coupled in series with the actuator valve.

16. The excavator of claim 15 wherein the valve stack includes a plurality of actuator valves coupled to the pump system down stream of the motor valve and coupled to the plurality of hydraulic actuators, the plurality of actuator valves being connected in parallel with one another and the motor valve being connected in series with the plurality of actuator valves.

17. The excavator of claim 15 wherein the motor valve is coupled to the pump system and the slew motor.

18. The excavator of claim 15 wherein the plurality of movable elements comprises a boom movably connected to the house, an arm movably connected to the boom, and a tool movably connected to the arm, and wherein the plurality of hydraulic actuators comprises a boom cylinder coupled to the boom and the house, an arm cylinder coupled to the boom and the arm, and a tool cylinder coupled to the arm and the tool.

19. The excavator of claim 15 wherein the plurality of movable elements comprises a blade movably coupled to the track assemblies and a boom movably coupled to the house and wherein the plurality of hydraulic actuators comprises a blade cylinder coupled to the blade and an offset cylinder coupled to the house and the boom.

20. The excavator of claim 15 wherein the valve stack includes a boost valve coupled down stream of the actuator valve and receiving hydraulic fluid not previously diverted from the boost valve by the actuator valve, the boost valve being movable between a first position and a second position and diverting the received hydraulic fluid to a first hydraulic actuator when the boost valve is in the first position and to a second hydraulic actuator when the boost valve is in the second position.

21. The excavator of claim 20 wherein the hydraulic actuators receiving hydraulic fluid from the boost valve have valves associated therewith and wherein the boost valve is configured to provide the hydraulic fluid to one of the first and second hydraulic actuators when the valve associated with the one of the first and second hydraulic actuators is in a predetermined position.

22. A power machine, comprising:

a base;

first and second traction assemblies coupled to the base to provide travel of the power machine;

an operator support portion movably mounted to the base;

a first plurality of hydraulic actuators;

a second plurality of hydraulic actuators;

a hydraulic power circuit providing hydraulic fluid under pressure to the first and second plurality of hydraulic actuators, the hydraulic power circuit comprising:

a pump;

a first plurality of valves coupled to the pump and each of the first plurality of valves being coupled to one of the first plurality of hydraulic actuators; and a second plurality of valves coupled to the pump and each valve being coupled to one of the second plurality of hydraulic actuators, the second plurality of valves being coupled to also receive available hydraulic fluid from the first plurality of valves.

23. The power machine of claim 22 wherein one of the second plurality of valves comprises an auxiliary valve coupled to selectively provide hydraulic fluid to an auxiliary connection.

24. An excavator, comprising:

first and second track assemblies;

first and second hydraulic traction motors coupled to the first and second track assemblies, respectively;

a house rotatably mounted to the track assemblies;

a hydraulic slew motor coupled to the house to rotate the house;

a plurality of movable elements, movable relative to the house;

a plurality of hydraulic actuators coupled to the plurality of movable elements to controllably move the movable elements;

a hydraulic power circuit providing hydraulic fluid under pressure to the hydraulic traction motors, the hydraulic slew motor and the plurality of hydraulic actuators, the hydraulic power circuit comprising:

a pump system providing the hydraulic fluid; and a valve stack including a slew motor valve coupled to the pump system, the valve stack including an actuator valve coupled to one of the plurality of hydraulic actuators and to the pump system down stream of the slew motor valve, the slew motor valve being coupled in series with the actuator valve.

* * * * *

UNITED STATES PATENT AND TRADEMARK OFFICE

CERTIFICATE OF CORRECTION

PATENT NO. : 6,029,446
DATED : February 29, 2000
INVENTOR(S) : Gerald J. Duppong et al.

It is certified that error appears in the above-identified patent and that said Letters Patent is hereby corrected as shown below:

Title page,
Item [73], Assignee, delete "Melroe Company, Fargo, N. Dak." insert -- Clark Equipment Company, Wood Cliff Lake, New Jersey --.

Signed and Sealed this

Nineteenth Day of February, 2002

*Attest:*

*Attesting Officer*

JAMES E. ROGAN
*Director of the United States Patent and Trademark Office*